US008465806B2

(12) United States Patent
Van Veldhuizen et al.

(10) Patent No.: US 8,465,806 B2
(45) Date of Patent: Jun. 18, 2013

(54) METHOD FOR HOT DIP GALVANIZING OF AHSS OR UHSS STRIP MATERIAL, AND SUCH MATERIAL

(75) Inventors: Hendrik Bart Van Veldhuizen, Beverwijk (NL); Petrus Gerardus Commadeur, Beverwijk (NL)

(73) Assignee: Tata Steel Ijmuiden B.V., Ijmuiden (NL)

( * ) Notice: Subject to any disclaimer, the term of this patent is extended or adjusted under 35 U.S.C. 154(b) by 707 days.

(21) Appl. No.: 12/598,366

(22) PCT Filed: Apr. 29, 2008

(86) PCT No.: PCT/EP2008/055209

§ 371 (c)(1),
(2), (4) Date: Feb. 24, 2010

(87) PCT Pub. No.: WO2008/135445

PCT Pub. Date: Nov. 13, 2008

(65) Prior Publication Data

US 2010/0178527 A1 Jul. 15, 2010

(30) Foreign Application Priority Data

May 2, 2007 (EP) ..... 07008853

(51) Int. Cl.
*B05D 7/00* (2006.01)

(52) U.S. Cl.
USPC ..... 427/329; 427/328; 427/327; 427/436

(58) Field of Classification Search
USPC ..... 427/430.1, 327, 328, 434.2, 435, 427/436
See application file for complete search history.

(56) References Cited

U.S. PATENT DOCUMENTS

| | | | | |
|---|---|---|---|---|
| 5,284,680 | A * | 2/1994 | Bilimoria | 427/307 |
| 5,411,812 | A | 5/1995 | Bilimoria | |
| 6,395,108 | B2 * | 5/2002 | Eberle et al. | 148/330 |
| 6,635,313 | B2 * | 10/2003 | Pradhan et al. | 427/383.7 |
| 6,767,652 | B2 * | 7/2004 | Yamamoto et al. | 428/659 |
| 2001/0042393 | A1 | 11/2001 | Kefferstein et al. | |
| 2004/0166360 | A1 | 8/2004 | Imai et al. | |
| 2004/0177903 | A1 | 9/2004 | Francois | |
| 2004/0238080 | A1 | 12/2004 | Vandeputte et al. | |
| 2005/0252262 | A1 | 11/2005 | Imai et al. | |
| 2006/0124907 | A1 * | 6/2006 | Takada et al. | 252/500 |
| 2006/0137768 | A1 * | 6/2006 | Yuse et al. | 148/320 |
| 2007/0020478 | A1 * | 1/2007 | Moon et al. | 428/659 |
| 2007/0289717 | A1 * | 12/2007 | Kroos et al. | 164/462 |

FOREIGN PATENT DOCUMENTS

| | | | |
|---|---|---|---|
| CA | 2644459 | A | 10/2007 |
| EP | 1 288 322 | A1 | 3/2003 |
| EP | 1 439 240 | A1 | 7/2004 |
| EP | 1 457 580 | A1 | 9/2004 |
| EP | 1 621 645 | A1 | 2/2006 |
| JP | 3-232952 | A | 10/1991 |
| JP | 4-224666 | A | 8/1992 |
| JP | 07034210 | A * | 2/1995 |
| JP | 8-325689 | A | 12/1996 |
| WO | 2007/109865 | A1 | 10/2007 |

OTHER PUBLICATIONS

Anonymous "Advanced Low Carbon Cold Rolled Steel Strip", University of Liverpool, online 2002 XP002455147, (2002).

* cited by examiner

*Primary Examiner* — David Turocy
(74) *Attorney, Agent, or Firm* — Novak Druce Connolly Bove + Quigg, LLP

(57) ABSTRACT

A method for hot dip galvanizing of advanced high strength or ultra high strength steel strip material, such as dual phase steel, transformation induced plasticity steel, transformation induced plasticity assisted dual phase steel and twinning induced plasticity steel strip material. The strip material is pickled and thereafter heated to a temperature below the continuous annealing temperature before the strip material is hot dip galvanized.

20 Claims, 1 Drawing Sheet

METHOD FOR HOT DIP GALVANIZING OF AHSS OR UHSS STRIP MATERIAL, AND SUCH MATERIAL

CROSS REFERENCE TO RELATED APPLICATIONS

This application is a §371 National Stage Application of International Application No. PCT/EP2008/055209, filed on 29 Apr. 2008, claiming the priority of European Patent Application No. 07008853.9 filed on 2 May 2007.

The invention relates to a method for hot dip galvanising of advanced high strength or ultra high strength steel strip material.

Advanced high strength steel (AHSS) and ultra high strength steel (UHSS) are commonly used indications for steel types that have a higher yield strength than the usual C—Mn steels and high strength steels. AHSS has a yield strength above 400 MPa, UHSS a yield strength above 600 Mpa. For ease of reading, AHSS and UHSS will together be indicated by AHSS in this description.

AHSS types are especially developed for the automotive industry. AHSS types are for instance dual phase (DP) steel, transformation induced plasticity (TRIP) steel, TRIP assisted dual phase (TADP) steel and twinning induced plasticity (TWIP) steel. These steel types generally have a number behind the abbreviation indicating the yield strength, such as DP600 and TRIP700. Some of the AHSS types are already in production, others are under development.

For most automotive purposes, it is required that the AHSS strip material is covered with a zinc layer (which zinc layer sometimes comprises up to a few percent of other elements). However, it is well known in the art that AHSS types are difficult to coat with a zinc layer using hot dip galvanising, and it has been found that this is especially true for AHSS with large amounts of alloying elements, such as TWIP steel. Hot dip galvanising of such AHSS types according to the state of the art results in bare spots, flaking of the zinc layer, and the forming of cracks in the zinc layer during deformating of the zinc coated AHSS material.

It is an object of the invention to provide an improved method for hot dip galvanising of AHSS steel strip material.

It is a further object of the invention to provide a method for hot dip galvanising of AHSS strip material by which the forming of bare spots in and flaking of the zinc layer is reduced or eliminated, and the forming of cracks in the zinc layer during deformation of the AHSS strip material is reduced or eliminated as well.

Moreover, it is an object of the invention to provide such hot dip galvanised AHSS strip material.

According to the invention one or more of these objects is reached using a method for hot dip galvanising of advanced high strength or ultra high strength steel strip material, such as DP steel, TRIP steel, TRIP assisted DP steel and TWIP steel strip material, wherein the strip material is pickled and thereafter heated to a temperature below the continuous annealing temperature before the strip material is hot dip galvanised.

With this method, the AHSS strip material is heated only to a temperature high enough to form a closed inhibition layer. This temperature is lower than the normal continuous annealing temperature necessary for metallurgical reasons (such as recrystallisation to influence mechanical properties). Due to the fact that the AHSS strip material is heated to a temperature below the normal continuous annealing temperature, the forming of oxides on the surface of the steel strip material can be reduced.

Preferably, the temperature below the continuous annealing temperature is between 400 and 600° C. In this temperature range the forming of oxides is considerably reduced and the strip material is heated sufficiently for the subsequent hot dip galvanizing.

According to a preferred embodiment, the Fe in the strip material is reduced during or after the heating to a temperature below the continuous annealing temperature and before the hot dip galvanising. By reducing the strip material, the Fe-oxides that are formed are reduced, and in this way the amount of oxides present on the surface of the strip material before hot dip galvanizing is decreased considerably.

Preferably, the reduction is performed using $H_2N_2$, more preferably using 5-30% $H_2N_2$ in the reducing atmosphere. It has been found that with the use of this atmosphere most oxides can be removed.

According to a preferred embodiment, an excess amount of $O_2$ is provided in the atmosphere during or after the heating of the strip material and before the reduction of the strip material. The providing of an excess amount of oxygen improves the quality of the surface of the steel strip material before the hot dip galvanizing, and thus the quality of the zinc layer coated on the AHSS strip material. It is supposed that the oxygen binds the alloying elements in the AHSS strip material both at the surface of the strip material and internally, and that in this way the oxides formed cannot migrate to the surface of the strip material. The reducing atmosphere that follows after the oxidation will then reduce the oxides at the surface of the strip material, and in this way the amount of oxides at the surface of the strip material is considerably reduced or even almost absent, as experiments have shown.

Preferably, the excess amount of $O_2$ is provided in an amount of 0.05-5% $O_2$. This amount of oxygen has been found to suffice.

According to a first preferred embodiment, the steel strip material is hot dip galvanised as a hot rolled strip material. Thus, hot rolled AHSS strip material can be hot dip galvanised, in whichever way the strip material has been produced for instance by semi-continuous casting.

Preferably, the hot rolled strip material is hot dip galvanised without a continuous annealing step between the hot rolling and the hot dip galvanising of the strip material. Such a continuous annealing step is not needed according to the method of the invention, and in this way a considerable cost saving is realised.

According to a second preferred embodiment, the steel strip material is hot dip galvanised as a cold rolled product, which has been annealed after cold rolling and before pickling. In this way cold rolled hot dip galvanised AHSS strip material is provided, suitable for the automotive industry.

Preferably, the steel strip material has been pickled before cold rolling. Pickling is (often) necessary before cold rolling to remove oxides, to prevent rolling in of oxides.

Preferably, the cold rolled strip material is produced from a hot rolled strip material or a belt cast strip material. Especially for AHSS strip material it is necessary to choose a suitable casting and hot rolling method.

It will thus be clear that for using the method according to the invention for cold rolled AHSS material pickling is performed both before and after the cold rolling step.

According to a preferred embodiment, the advanced high strength or ultra high strength steel strip material comprises 0.04-0.30% C, 1.0-3.5% Mn, 0-1.0% Si, 0-2.0% Al and 0-1.0% Cr. Other elements can be present, such as V, Nb, Ti and B, but usually in a small amount.

Preferably, the steel strip material is a transformation induced plasticity steel strip material, comprising 0.15-

0.30% C, 1.5-3.5% Mn, 0.2-0.8% Si and 0.5-2.0% Al, preferably 0.15-0.24% C, 1.5-2.0% Mn, 0.2-0.6% Si and 0.5-1.5 5 Al. here as well small amounts of other alloying elements can be present.

According to a preferred embodiment of all the embodiments discussed above, the steel strip material is TWIP steel strip material comprising between 10 and 40% manganese, preferably between 12 and 25% manganese, and up to 10% aluminium. TWIP steel strip material is very difficult to galvanize properly, and the method according to the invention has proven to be suitable for the TWIP steel strip material with the amount of manganese as mentioned.

According to a second aspect of the invention there has been provided an advanced high strength or ultra high strength steel strip material produced in accordance with the description above, comprising a hot dip galvanised zinc layer on the steel strip material, which zinc layer is essentially free from bare spots, flakes or cracks during deformation. This AHSS strip material is very much suitable for the automotive industry.

Preferably, oxides between the steel strip material and the zinc layer are essentially absent. Due to the absence of oxides, the zinc layer adheres very well to the AHSS strip material.

Preferably, the AHSS strip material is TWIP steel strip material containing between 10 and 40% manganese, comprising a hot dip galvanised zinc layer on the steel strip material, which zinc layer is essentially free from bare spots, flakes or cracks during deformation.

The invention will be elucidated in an example, referring to the accompanying drawing.

According to an example, TWIP steel strip material contains 14.8% Mn and 3% Al as alloying elements. After hot rolling, pickling and cold rolling, the TWIP steel strip material is continuous annealed to a temperature of approximately 800° C. and pickled again. Then the strip material is heated to a temperature of 527° C. in an annealing line, and thereafter hot dip galvanised in a galvanising bath at approximately 450° C.

During the heating of the strip material to the temperature of 527° C., an excess amount of 1% $O_2$ is provided. The oxygen stat is provided at such a high temperature not only forms oxides at the surface of the strip material, but also at some depth under the surface binds the alloying elements.

After the providing of the oxygen, the strip material is reduced using approximately 5% $H_2N_2$. The reduction of the strip material removes the oxides from the surface, but the oxides formed under the surface remain where they are and cannot migrate to the surface. Thus, by reducing the surface the oxides are effectively removed and no new oxides can be formed at the surface.

It is presumed that by normal reduction, the alloying elements that are present in high amounts in AHSS types migrate to the surface very fast at the alloying temperature and thus form oxides at the surface again before the hot dip galvanising takes place.

Figure 1:
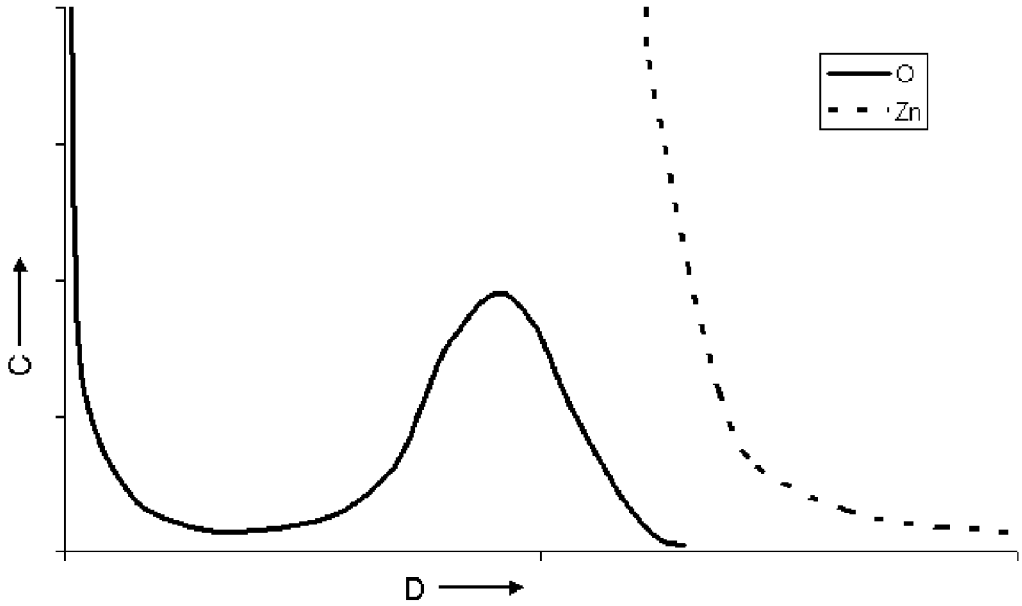
FIG. 1 shows the oxides present in a cross-section through a galvanised TWIP strip, according to the state of the art.
Figure 2:
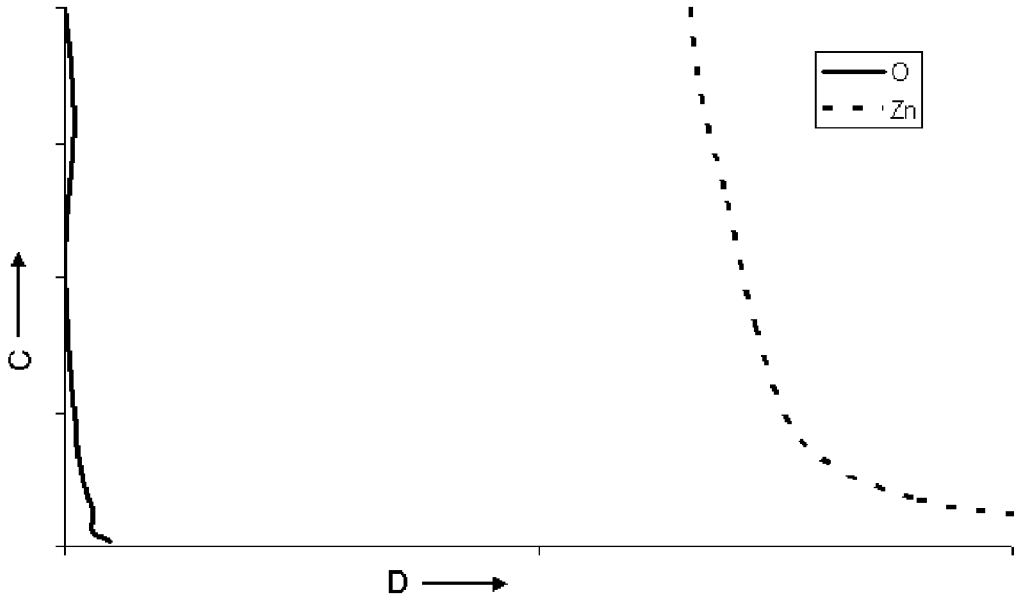
FIG. 2 shows the oxides present in a cross-section through a galvanised TWIP strip, produced in accordance with the present invention.

Whatever the exact mechanism may be, it has been found that the use of the method according to the invention clearly diminishes or almost eliminates the amount of oxides found in a hot dip galvanised zinc layer on a TWIP steel. FIG. 1 shows the oxides present in a cross-section through such a layer, according to the state of the art. On the horizontal axis, the distance under the surface of the zinc layer is given, and on the vertical axis, the amount of oxides and zinc is given (both in FIG. 1 and FIG. 2). It is clear from FIG. 1 that a lot of oxides are present at the transition from steel substrate to zinc covering. These oxides cause a bad adhesion of the zinc layer to the substrate, resulting in bare spots, flaking and the forming of cracks in the zinc layer when the material is bent. FIG. 2 shows the oxides present in a cross-section through a galvanised TWIP strip, produced in accordance with the present invention. The oxides are (almost) not present anymore, and the hot dip galvanised TWIP steel strip material according to the invention has a far better performance regarding bare spots, flaking and cracks compared to the material that has been hot dip galvanised according to the state of the art.

The invention claimed is:

1. Method for hot dip galvanizing of dual phase steel, transformation induced plasticity steel, transformation induced plasticity assisted dual phase steel or twinning induced plasticity steel strip material comprising, pickling the strip material and thereafter heating the pickled strip material to a temperature below a continuous annealing temperature of the strip material, between 400 and 600° C., before the strip material is hot dip galvanized;

wherein Fe in the strip material is reduced during or after the heating to a temperature below the continuous annealing temperature and before the hot dip galvanizing;

hot dip galvanizing the strip material after said heating, wherein the reduction is performed using $H_2N_2$ in the reducing atmosphere.

2. Method according to claim 1, wherein an excess amount of $O_2$ is provided in the atmosphere during or after the heating of the strip material and before the reduction of the strip material.

3. Method according to claim 2, wherein the excess amount of $O_2$ is provided in an amount of 0.05-5% $O_2$.

4. Method according to claim 1, wherein the steel strip material is hot rolled before galvanizing to form a hot rolled strip material and the steel strip material is hot dip galvanized as the hot roiled strip material.

5. Method according to claim 4, wherein the hot rolled strip material is hot dip galvanized without a continuous annealing step between the hot rolling and the hot dip galvanizing of the strip material.

6. Method according to claim 1, wherein the steel strip material is cold rolled before galvanizing and hot dip galvanized as a cold rolled product, which has been annealed after cold roiling and before pickling.

7. Method according to claim 6, wherein the steel strip material has been pickled before the cold rolling.

8. Method according to claim 1, wherein the cold rolled strip material is produced from a hot rolled strip material or a belt cast strip material.

9. Method according to claim 1, wherein the steel strip material comprises 0.04-0.30% C, 1.0-3.5% Mn, 0-1.0% Si, 0-2.0% Al and 0-1.0% Cr, the remainder being Fe and inevitable impurities.

10. Method according to claim 9, wherein the steel strip material is a transformation induced plasticity steel strip material, comprising 0.15-0.30% C, 1.5-3.5% Mn, 0.2-0.8% Si and 0.5-2.0% Al, the remainder being Fe and inevitable impurities.

11. Method according to claim 9, wherein the steel strip material is a transformation induced plasticity steel strip material, comprising 0.15-0.24% C, 1.5-2.0% Mn, 0.2-0.6% Si and 0.5-1.5% Al, the remainder being Fe and inevitable impurities.

12. Method according to claim 1, wherein the steel strip material is a twinning induced plasticity steel strip material comprising between 10 and 40% manganese, and up to 10 aluminium.

13. Method according to claim 1, wherein the steel strip material is a twinning induced plasticity steel strip material comprising between 12 and 25% manganese, and up to 10% aluminium.

14. Method for hot dip galvanizing of dual phase steel, transformation induced plasticity steel, transformation induced plasticity assisted dual phase steel or twinning induced plasticity steel strip material comprising, pickling the strip material and thereafter heating the pickled strip material to a temperature below a continuous annealing temperature of the strip material, between 400 and 600° C., before the strip material is hot dip galvanized;

wherein Fe in the strip material is reduced during or after the heating to a temperature below the continuous annealing temperature and before the hot dip galvanizing;

hot dip galvanizing the strip material after said heating, wherein the reduction is performed using 5-30% $H_2N_2$ in the reducing atmosphere.

15. Method according to claim 14, wherein an excess amount of $O_2$ is provided in the atmosphere during or after the heating of the strip material and before the reduction of the strip material.

16. Method according to claim 15, wherein the excess amount of $O_2$ is provided in an amount of 0.05-5% $O_2$.

17. Method according to claim 14, wherein the steel strip material is cold rolled before galvanizing and hot dip galvanized as a cold rolled product, which has been annealed after cold rolling and before pickling.

18. Method according to claim 14, wherein the steel strip material comprises 0.04-0.30% C, 1.0-3.5% Mn, 0-1.0% Si, 0-2.0% Al and 0-1.0% Cr, the remainder being Fe and inevitable impurities.

19. Method according to claim 14, wherein the steel strip material is a twinning induced plasticity steel strip material comprising between 10 and 40% manganese, and up to 10 aluminium.

20. Method according to claim 14, wherein the steel strip material is a transformation induced plasticity steel strip material, comprising 0.15-0.30% C, 1.5-3.5% Mn, 0.2-0.8% Si and 0.5-2.0% Al, the remainder being Fe and inevitable impurities.

* * * * *